US011631384B2

(12) United States Patent
Liu et al.

(10) Patent No.: US 11,631,384 B2
(45) Date of Patent: Apr. 18, 2023

(54) MECHANICAL CONNECTIONS IN PIANO-ACTION OF PIANO

(71) Applicant: SUNLAND INFORMATION TECHNOLOGY CO., LTD., Shanghai (CN)

(72) Inventors: Xiaolu Liu, Shanghai (CN); Kaiwen Li, Shanghai (CN); Yangyi Teng, Shanghai (CN)

(73) Assignee: SUNLAND INFORMATION TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/920,748

(22) Filed: Jul. 5, 2020

(65) Prior Publication Data

US 2020/0335068 A1 Oct. 22, 2020

Related U.S. Application Data

(63) Continuation of application No. PCT/CN2019/084882, filed on Apr. 29, 2019.

(30) Foreign Application Priority Data

Sep. 30, 2018 (CN) ..... 201811156609.2
Sep. 30, 2018 (CN) ..... 201811157567.4
(Continued)

(51) Int. Cl.
*G10C 3/16* (2019.01)

(52) U.S. Cl.
CPC ..... *G10C 3/16* (2013.01)

(58) Field of Classification Search
CPC ... G10C 3/16; G10C 1/02; G10C 1/04; G10C 3/168
See application file for complete search history.

(56) References Cited

U.S. PATENT DOCUMENTS

2017/0025099 A1 1/2017 Ohba et al.
2019/0019484 A1* 1/2019 Taniguchi ..... G10C 3/12

FOREIGN PATENT DOCUMENTS

CN 106373542 A * 2/2017 ..... G10C 3/168
CN 206097880 U 4/2017
(Continued)

OTHER PUBLICATIONS

International Search Report in PCT/CN2019/084882 dated Jul. 31, 2019, 5 pages.
(Continued)

*Primary Examiner* — Kimberly R Lockett
(74) *Attorney, Agent, or Firm* — Metis IP LLC

(57) ABSTRACT

The present disclosure relates to a piano-action. The piano-action may comprises a first moving component including a concavity structure, a second moving component including a convexity structure, wherein the convexity structure and the concavity structure are configured to match each other and capable of being clipped together, and a third moving component being thin and flexible and configured to fixedly fit between the first moving component and the second moving component when the convexity structure of the second moving component is clipped into the concavity structure of the first moving component.

9 Claims, 8 Drawing Sheets

(30) Foreign Application Priority Data

Sep. 30, 2018 (CN) ..... 201821611854.3
Sep. 30, 2018 (CN) ..... 201821623513.8

(56) References Cited

FOREIGN PATENT DOCUMENTS

| | | | | | |
|---|---|---|---|---|---|
| CN | 206259159 | U | | 6/2017 | |
| CN | 109147721 | A | | 1/2019 | |
| CN | 109147722 | A | | 1/2019 | |
| JP | 2007218958 | A | * | 8/2007 | ..... G10C 3/16 |
| JP | 2007218958 | A | | 8/2007 | |
| JP | 2008256787 | A | | 10/2008 | |

OTHER PUBLICATIONS

Written Opinion in PCT/CN2019/084882 dated Jul. 31, 2019, 5 pages.

* cited by examiner

MECHANICAL CONNECTIONS IN PIANO-ACTION OF PIANO

CROSS-REFERENCE TO THE RELATED APPLICATIONS

This application is a continuation of International Application No. PCT/CN2019/084882, filed on Apr. 29, 2019, which claims priority of Chinese Patent Application No. 201811157567.4, filed on Sep. 30, 2018, Chinese Patent Application No. 201811156609.2, filed on Sep. 30, 2018, Chinese Patent Application No. 201821611854.3, filed on Sep. 30, 2018, and Chinese Patent Application No. 201821623513.8, filed on Sep. 30, 2018, the entire contents of which are hereby incorporated by reference.

TECHNICAL FIELD

This disclosure generally relates to mechanical connections, and more particularly, relates to mechanical connections between components of a piano-action.

BACKGROUND

Traditionally, main structure of a piano-action is made of wood, and movable joints (e.g., shafts) in the piano-action, use short metallic rods. A main disadvantage of the traditional piano-action is that the main structure made of wood is sensitive to temperature and humidity of the environment, and the piano-action need to be adjusted frequently according to the environment, thus resulting in a large cost for maintenance.

Carbon fiber material has been applied in the main structure of the piano-action, so as to reduce the dependency of the piano-action on temperature and humidity of the environment. However, carbon fiber material itself is costly, and the movable joints need to use specially-processed composite shafts, which are difficult to manufacture and have a large cost as well.

At present, piano-actions made of plastic are produced, reducing the dependency of piano-actions on temperature and humidity of the environment. However, shafts of the piano-actions made of metallic material need to use composite linings, which are difficult to manufacture and assemble, and failure problems occur frequently.

Therefore, it is desirable to provide a piano-action and a piano thereof to avoid the use of shafts in rotating devices or components under small impulsive forces due to manufacturing difficulties and potential failures of the shafts, which has become an urgent technical problem to be addressed.

SUMMARY

According to an aspect of the present disclosure, a piano-action may be provided. The piano-action may comprises a first moving component including a concavity structure; a second moving component including a convexity structure, wherein the convexity structure and the concavity structure are configured to match each other and capable of being clipped together; and a third moving component being thin and flexible and configured to fixedly fit between the first moving component and the second moving component when the convexity structure of the second moving component is clipped into the concavity structure of the first moving component.

In some embodiments, the third moving component fits into an inner surface of the concavity structure of the first moving component before the convexity structure of the second moving component is clipped into the concavity structure.

In some embodiments, the third moving component is a tape.

In some embodiments, the tape is a bridle tape.

In some embodiments, an end of the second moving component is connected to the first moving component through a mechanical joint, and the second moving component is configured to move around the mechanical joint.

In some embodiments, no adhesive is used to fasten the third moving component to the first moving component or the second moving component.

According to another aspect of the present disclosure, a piano may be provided. The piano may comprises a piano-action, the piano-action including a hammer butt including a concavity structure; a tape-clip component including a convexity structure, wherein the convexity structure and the concavity structure are configured to match each other and capable of being clipped together; and a tape being configured to fixedly fit between the hammer butt and the tape-clip component when the convexity structure of the tape-clip component is clipped into the concavity structure of the hammer butt.

In some embodiments, the tape fits into an inner surface of the concavity structure before the convexity structure of the tape-clip component is clipped into the concavity structure of the hammer butt.

In some embodiments, the tape is a bridle tape and no adhesive is used to fasten the bridle tape to the hammer butt or the tape-clip component.

In some embodiments, an end of the tape-clip component is connected to the hammer butt through a mechanical joint, and the tape-clip component is configured to move around the mechanical joint.

According to a further aspect of the present disclosure, a piano-action may be provided. The piano-action may comprises a moving device, the moving device including one or more moving components, wherein at least one of the moving components includes an elastic portion, the one or more moving components are configured to move, relatively to each other, through deformation of the elastic portion of the at least one moving component.

In some embodiments, the one or more moving components includes a first moving component; and a second moving component, wherein a first end of the first moving component is physically fixed on the second moving component, the first moving component includes the elastic portion, a second end of the first moving component is configured to move, relatively to the second moving component, through deformation of the elastic portion.

In some embodiments, the second end of the first moving component is configured to rotate around the elastic portion.

In some embodiments, the elastic portion is made of elastic material having a small thickness.

In some embodiments, the material of the elastic portion includes metallic materials, inorganic non-metallic materials, high polymer materials, or composite materials.

According to a further aspect of the present disclosure, a piano may be provided. The piano may comprises a piano-action, the piano-action including a moving device, the moving device including one or more moving components, wherein at least one of the moving components includes an elastic portion, the one or more moving components are configured to move, relatively to each other, through deformation of the elastic portion of the at least one moving component.

In some embodiments, the one or more moving components includes a damper lever flang, and a damper lever, wherein a first end of the damper lever flang is physically fixed on the damper lever, the damper lever flang includes the elastic portion, and a second end of the damper lever flang is configured to move, relatively to the damper lever, through deformation of the elastic portion.

In some embodiments, the second end of the damper lever flang is configured to rotate around the elastic portion.

In some embodiments, the elastic portion is made of elastic material having a small thickness.

In some embodiments, the material of the elastic portion includes metallic materials, inorganic non-metallic materials, high polymer materials, or composite materials.

According to a further aspect of the present disclosure, a piano-action may be provided. The piano-action may comprises a first moving component including a convexity structure; a second moving component including a concavity structure; and a connecting component configured to rotatably connect the first moving component to the second moving component by assembling the convexity structure into the concavity structure, wherein the convexity structure and the concavity structure have different radians and are configured to match each other.

In some embodiments, the radian of the concavity structure is larger than the radian of the convexity structure, and the first moving component rotates, relative to the second moving component, in an angle range according to a difference between the radian of the concavity structure and the radian of the convexity structure.

In some embodiments, the connecting component has elasticity, and the convexity structure is assembled into the concavity structure through a resilience force imposed by an elasticity deformation of the connecting component.

In some embodiments, the first moving component includes a first hole perpendicular to a plane in which the first moving component rotates relative to the second moving component, the second moving component includes a second hole parallel to the first hole, the connecting component includes a first rod, a second rod, and an elastic portion configured between the first rod and the straight rod, the first rod and the second rod being configured to insert into the first hole and the second hole, respectively, and the connecting component connects the first moving component to the second moving component through a resilience force imposed by an elasticity deformation of the elastic portion.

In some embodiments, the first moving component includes a first notch in a first plane and a second notch in a second plane, the first plane and the second plane being parallel to each other, the second moving component includes a hole in a third plane parallel to the first plane and second plane, the connecting component includes a first hook, a second hook, and a rod, the first hook and the second hook being deformable, and the connecting component connects the first moving component to the second moving component by inserting the rod into the hole and assembling the first hook and the second hook into the first notch and the second notch, respectively.

In some embodiments, the convexity structure protrudes in a direction perpendicular to the first plane and the second plane, the first notch and the second notch being close to the protrusion of the convexity structure.

In some embodiments, the connecting component includes an arc-shaped bushing, an inner surface of the bushing being configured to match the convexity structure of the first moving component, and an outer surface of the bushing being configured to match the concavity structure of the second moving component; and the connecting component is configured to rotatably connect the first moving component to the second moving component by assembling the convexity structure of the first moving component into the inner surface of the bushing and assembling the outer surface of the busing into the concavity structure of the second moving component.

In some embodiments, the convexity structure includes at least one pair of insertion pieces at two opposite sides of the convexity structure, the concavity structure includes a groove at the bottom of the concavity structure, at least two pairs of primary flanks at two opposite sides of the concavity structure, and primary slots between adjacent primary flanks at a same side of the concavity structure, the bushing includes at least two pairs of secondary flanks at two opposite sides of the bushing, a positioning slice at the middle of the outer surface of the bushing, and secondary slots between adjacent secondary flanks at a same side, the at least two pairs of secondary flanks being configured to match the at least two pairs of primary flanks, and the positioning slice being configured to match the groove, the convexity structure is assembled into the inner surface of the bushing by inserting the at least one pair of insertion pieces into the secondary slots, and the bushing is assembled into the concavity structure by inserting the positioning slice into the groove and clasping the at least two pairs of secondary flanks beneath the at least two pairs of primary flanks.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. The drawings are not to scale. These embodiments are non-limiting exemplary embodiments, in which like reference numerals represent similar structures throughout the several views of the drawings, and wherein.

DETAILED DESCRIPTION

Figure 1:
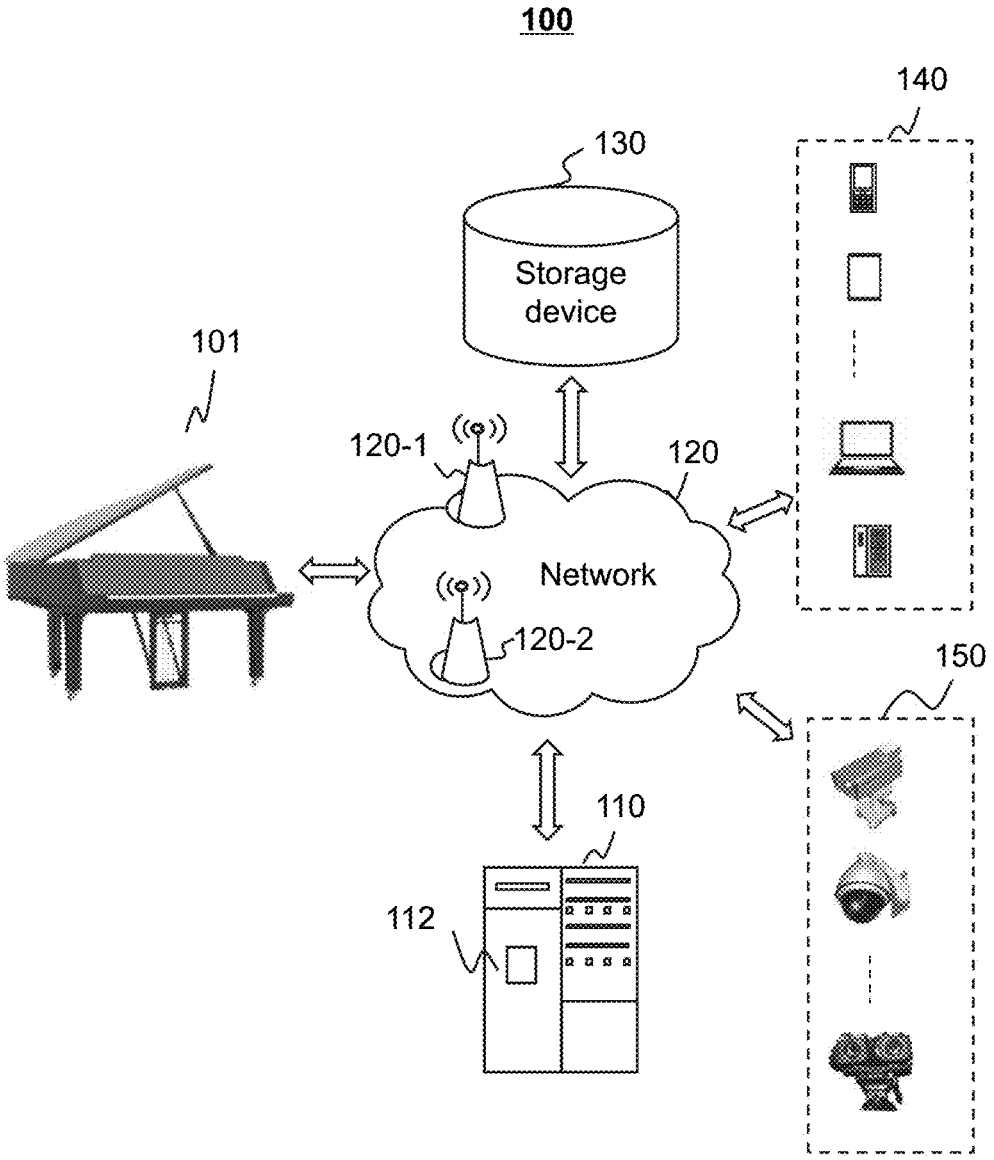
FIG. 1 is a schematic diagram illustrating an exemplary piano system according to some embodiments of the present disclosure.

In order to illustrate the technical solutions related to the embodiments of the present disclosure, brief introduction of the drawings referred to in the description of the embodiments is provided below. Obviously, drawings described below are only some examples or embodiments of the present disclosure. Those having ordinary skills in the art, without further creative efforts, may apply the present disclosure to other similar scenarios according to these drawings. Unless stated otherwise or obvious from the context, the same reference numeral in the drawings refers to the same structure and operation.

As used in the disclosure and the appended claims, the singular forms "a," "an," and "the" include plural referents unless the content clearly dictates otherwise. It will be further understood that the terms "comprises," "comprising," "includes," and/or "including" when used in the disclosure, specify the presence of stated steps and elements, but do not preclude the presence or addition of one or more other steps and elements.

Some modules or components of the device may be referred to in various ways according to some embodiments of the present disclosure. These modules or components are intended to be illustrative, not intended to limit the scope of the present disclosure. Different modules or components may be used in different aspects of the device.

Technical solutions of the embodiments of the present disclosure be described with reference to the drawings as described below. It is obvious that the described embodiments are not exhaustive and are not limiting. Other embodiments obtained, based on the embodiments set forth in the present disclosure, by those with ordinary skill in the art without any creative works are within the scope of the present disclosure.

An aspect of the present disclosure is directed to mechanical connection mechanisms in a piano-action of a piano. One or more components in the piano-action may be connected using the mechanical connection mechanisms instead of using shaft, bolts, adhesives, etc.

FIG. 1 is a schematic diagram illustrating an exemplary piano system according to some embodiments of the present disclosure. The piano system 100 may include a piano 101.

The piano 101 may be an acoustic piano, an electronic piano, a digital piano, or the like, or a combination thereof. The piano that may be used in connection with some embodiments of the present disclosure may include a grand piano, an upright piano, a square piano, a specialized piano (such as a toy piano, a minipiano), etc.

The piano 101 may include a piano frame, a keyboard, pedals, metal strings, a piano-action, and a soundboard. The piano frame may be a wooden case accommodating the keyboard, the pedals, the metal strings, the piano-action, and the soundboard. The keyboard may include a plurality of keys (e.g., white keys and black keys). For example, the keyboard may have a row of 88 keys including 52 white keys and 36 black keys. The pedals may be foot-operated levers at the base of a piano that change the instrument's sound in various ways. The pedals may include damper pedals, soft pedals, sostenuto pedals, etc. The metal strings may connect to the keys and vibrate at a resonant frequency to generate acoustic waves. The keys may be mechanically connected to hammers through the piano-action. The piano-action may translate the depression of a key into a motion of a hammer, which creates sound by striking the strings. The soundboard may be a large wooden board (e.g., a maple solid wood board for a high-grade piano, a medium density fiberboard for a low-grade piano) located inside the piano 101. The soundboard may be cling to the metal strings. When a key of a piano is pressed by a player, a hammer in the piano-action may strike a metal string and the metal string may vibrate at a resonant frequency to generate acoustic waves. The vibrations may be transmitted to the soundboard and amplified by coupling the acoustic energy to the air. The piano-action may also include a plurality of dampers. The dampers may contact with metal strings to prevent the metal strings from vibrating. When a key is released, a damper may stop the strings' vibration and end the sound. The piano-action will be described in detail below with reference to the drawings.

In some embodiments, the piano system 100 may be an intelligent piano system, which may further include a server 110, a network 120, a storage device 130, a smart device 140, and a camera 150. The piano 101 may be connected to and/or in communication with the server 110, the storage device 130, the smart device 140, the camera 150, or the like, via the network 120. In some embodiments, the one or more components of the piano system 100 may be centralized on the piano 101.

The server 110 may facilitate data processing for the piano system 100. In some embodiments, the server 110 may be a single server or a server group. The server group may be centralized, or distributed (e.g., server 110 may be a distributed system). In some embodiments, the server 110 may be local or remote. For example, the server 110 may access information and/or data stored in the piano 101, the storage device 130, the smart device 140, and/or the camera 150 via the network 120. As another example, the server 110 may be directly connected to the smart device 140, the piano 101, the camera 150, and/or the storage device 130 to access stored information and/or data. In some embodiments, the server 110 may be implemented on a cloud platform. Merely by way of example, the cloud platform may include a private cloud, a public cloud, a hybrid cloud, a community cloud, a distributed cloud, an inter-cloud, a multi-cloud, or the like, or any combination thereof. In some embodiments, the server 110 may be implemented on a computing device 200 having one or more components illustrated in FIG. 2 in the present disclosure.

In some embodiments, the server 110 may include a processing engine 112. The processing engine 112 may process information and/or data to perform one or more functions described in the present disclosure. In some embodiments, the processing engine 112 may include one or more processing engines (e.g., single-core processing engine(s) or multi-core processor(s)). Merely by way of example, the processing engine 112 may include one or more hardware processors, such as a central processing unit (CPU), an application-specific integrated circuit (ASIC), an application-specific instruction-set processor (ASIP), a graphics processing unit (GPU), a physics processing unit (PPU), a digital signal processor (DSP), a field-programmable gate array (FPGA), a programmable logic device (PLD), a controller, a microcontroller unit, a reduced instruction-set computer (RISC), a microprocessor, or the like, or any combination thereof.

The network 120 may facilitate the exchange of information and/or data. In some embodiments, one or more components in the piano system 100 (e.g., the server 110, the storage device 130, the smart device 140, the piano 101, and the camera 150) may send information and/or data to other component(s) in the piano system 100 via the network 120. In some embodiments, the network 120 may be any type of wired or wireless network, or a combination thereof. Merely by way of example, the network 120 may include a cable network, a wireline network, an optical fiber network, a telecommunications network, an intranet, the Internet, a local area network (LAN), a wide area network (WAN), a wireless local area network (WLAN), a metropolitan area network (MAN), a wide area network (WAN), a public telephone switched network (PSTN), a Bluetooth™ network, a ZigBee network, a near field communication (NFC) network, or the like, or any combination thereof. In some embodiments, the network 120 may include one or more network access points. For example, the network 120 may include wired or wireless network access points such as base stations and/or internet exchange points 120-1, 120-2, . . . , through which one or more components of the piano system 100 may be connected to the network 120 to exchange data and/or information.

The storage device 130 may store data and/or instructions. In some embodiments, the storage device 130 may store data obtained from the piano 101, the smart device 140, the camera 150, and/or the processing engine 112. In some embodiments, the storage device 130 may store data and/or instructions that the server 110 may execute or use to perform exemplary methods described in the present disclosure.

In some embodiments, the storage device 130 may include a mass storage, a removable storage, a volatile read-and-write memory, a read-only memory (ROM), or the like, or any combination thereof. Exemplary mass storage may include a magnetic disk, an optical disk, a solid-state drive, etc. Exemplary removable storage may include a flash drive, a floppy disk, an optical disk, a memory card, a zip disk, a magnetic tape, etc. Exemplary volatile read-and-write memory may include a random access memory (RAM). Exemplary RAM may include a dynamic RAM (DRAM), a double date rate synchronous dynamic RAM (DDR SDRAM), a static RAM (SRAM), a thyrisor RAM (T-RAM), and a zero-capacitor RAM (Z-RAM), etc. Exemplary ROM may include a mask ROM (MROM), a programmable ROM (PROM), an erasable programmable ROM (EPROM), an electrically-erasable programmable ROM (EEPROM), a compact disk ROM (CD-ROM), and a digital versatile disk ROM, etc. In some embodiments, the storage device 130 may be implemented on a cloud platform. Merely by way of example, the cloud platform may include a private cloud, a public cloud, a hybrid cloud, a community cloud, a distributed cloud, an inter-cloud, a multi-cloud, or the like, or any combination thereof.

In some embodiments, the storage device 130 may be connected to the network 120 to communicate with one or more components in the piano system 100 (e.g., the server 110, the smart device 140, the piano 101, and/or the camera 150). One or more components in the piano system 100 may access the data or instructions stored in the storage device 130 via the network 120. In some embodiments, the storage device 130 may be directly connected to or communicate with one or more components in the piano system 100 (e.g., the server 110, the smart device 140, the piano 101, and/or the camera 150). In some embodiments, the storage device 130 may be part of the server 110.

The smart device 140 may include a mobile device 140-1, a tablet computer 140-2, a laptop computer 140-3, or the like, or any combination thereof. In some embodiments, the mobile device 140-1 may include a smart home device, a wearable device, a mobile equipment, a virtual reality device, an augmented reality device, or the like, or any combination thereof. In some embodiments, the smart home device may include a smart lighting device, a control device of an intelligent electrical apparatus, a smart monitoring device, a smart television, a smart video camera, an interphone, or the like, or any combination thereof. In some embodiments, the wearable device may include a bracelet, footgear, glasses, a helmet, a watch, clothing, a backpack, a smart accessory, or the like, or any combination thereof. In some embodiments, the mobile equipment may include a mobile phone, a personal digital assistance (PDA), a gaming device, a navigation device, a point of sale (POS) device, a laptop, a desktop, or the like, or any combination thereof. In some embodiments, the virtual reality device and/or the augmented reality device may include a virtual reality helmet, a virtual reality glass, a virtual reality patch, an augmented reality helmet, augmented reality glasses, an augmented reality patch, or the like, or any combination thereof. For example, the virtual reality device and/or the augmented reality device may include a Google Glass™, a RiftCon™, a Fragments™, a Gear VR™, etc.

The camera 150 may be configured to capture image data associated with a user. As used herein, the "image data" may refer to a static image, a series of image frames, a video, etc. In some embodiments, the camera 150 may include a spherical camera, a hemispherical camera, a rifle camera, etc. In some embodiments, the camera 150 may include a black-white camera, a color camera, an infrared camera, an X-ray camera, etc. In some embodiments, the camera 150 may include a digital camera, an analog camera, etc. In some embodiments, the camera 150 may include a monocular camera, a binocular camera, a multi-camera, etc. In some embodiments, the camera 150 may be an IP camera which can transmit the captured image data to any component (e.g., the server 110, the smart device 140, the piano 101, and/or the storage device 130) of the piano system 100 via the network 120. In some embodiments, the camera 150 may be part of the smart device 140 or the piano 101.

It should be noted that the piano system 100 is merely provided for the purposes of illustration, and is not intended to limit the scope of the present disclosure. For persons having ordinary skills in the art, multiple variations or modifications may be made under the teachings of the present disclosure. For example, the piano system 100 may further include a database, an information source, or the like. As another example, the piano system 100 may be implemented on other devices to realize similar or different functions. However, those variations and modifications do not depart from the scope of the present disclosure.

Figure 2:
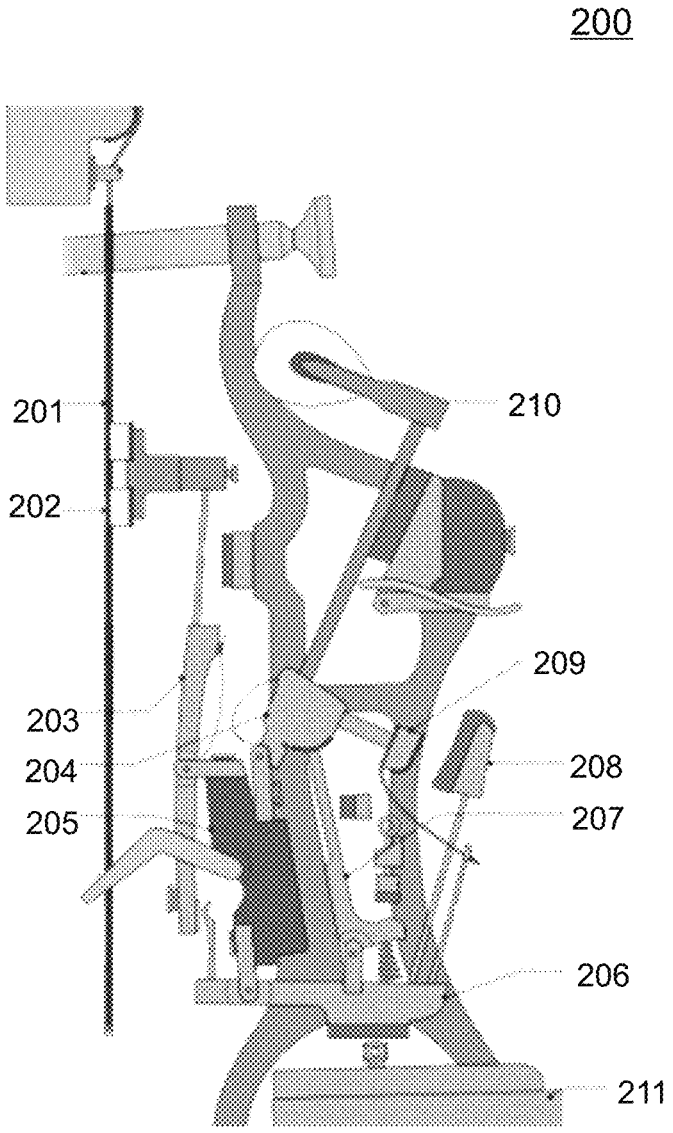
FIG. 2 is a schematic diagram illustrating exemplary components in a piano-action of an upright piano according to some embodiments of the present disclosure.

FIG. 2 is a schematic diagram illustrating exemplary components in a piano-action of an upright piano according to some embodiments of the present disclosure. The piano-action 200 may include a plurality of components that connect piano keys on a keyboard (e.g., a key 211 as illustrated) to metal strings (e.g., a metal string 201 as illustrated). When the key 211 is depressed, the plurality of components of the piano-action 200 may transfer the motion of the key 211 to the metal string 210.

A hammer 210 may be connected to the key 211 to strike the metal string 201 when the key 211 is depressed. The hammer 210 may include a hammer head for striking the metal string 201, a hammer shank formed into a thin and long bar shape, and a hammer butt 204 connected through the hammer shank.

The piano-action 200 further includes a wippen (also referred to as repetition base) 206 and a jack (also referred to repetition jack) 207. The jack 207 may be supported on the wippen 206. The jack 207 may connect with the hammer butt 204. When the key 211 is depressed, the wippen 206 may be pushed up by the key 211, and turns upward together with the jack 207 accordingly. Then the jack 207 pushes up the hammer butt 204 in aid of an action rail 205, and the hammer head may strike the string 201 to produce an acoustic sound. The action rail 205 may connect to an end of the wippen 206.

The piano-action 200 may further include a damper (also referred to as stopper). The damper may include a damper head 202, and a damper lever 203. The damper head 202 may connect to the damper leaver 204. The damper lever 203 may connect to the action rail 205 through a damper lever flange. When the key 211 is released, the motion of the key 211 may be transferred, through the wippen 206, the action rail 205, the damper lever flange, the damper lever 203, to the damper head 202. Then the damper head 202 may contact the string 201 such that the string 211 is stopped from vibrating and the acoustic sound is muted.

The hammer 210 may further include a hammer butt catcher 209. The hammer butt catcher 209 may connect to a backcheck 208 through a wire (also referred to as bridle tape). The backcheck 208 may catch and hold the hammer 210 after it rebounds from striking the string 201, and prepares for another repetition of a same note.

In some embodiments, mechanical connections between the components of the piano-action may use various mechanical connection mechanisms including but not limited to, shafts, bolts, adhesives, etc. In some embodiments, the connections between the components may use mechanical connection mechanisms described in the present disclosure, for example mechanical connection mechanisms illustrated in FIGS. 3A through 7.

Figure 3A:
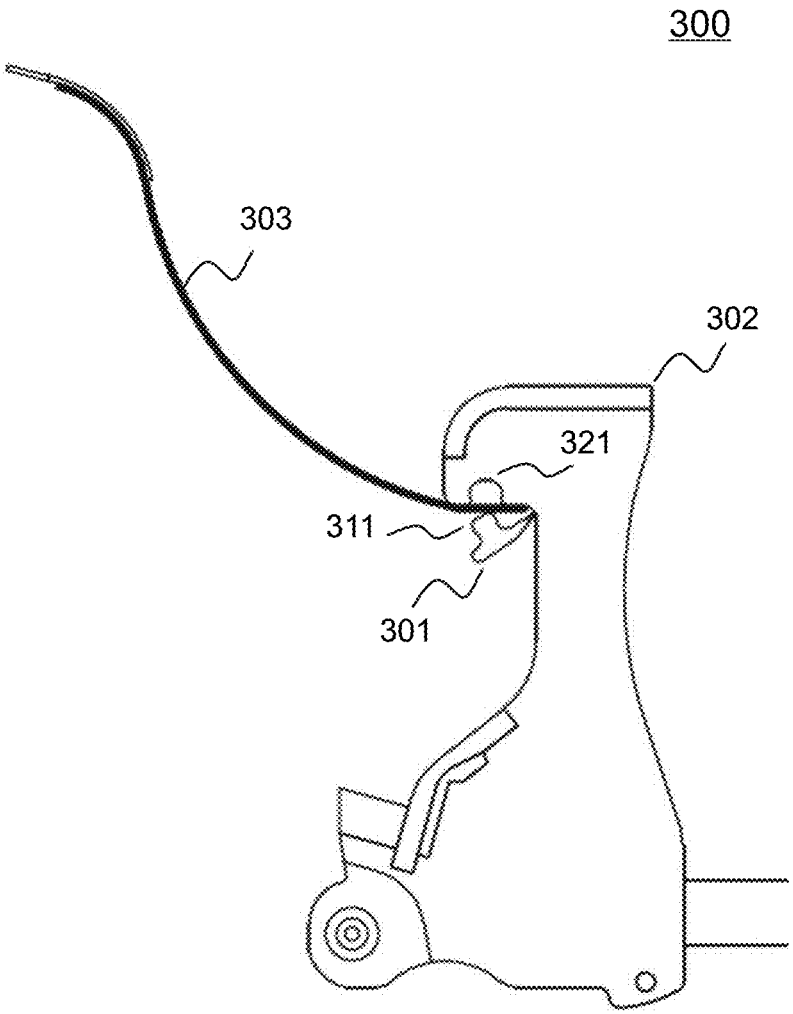
FIGS. 3A and 3B are schematic diagrams illustrating a mechanical connection mechanism between hammer butt and bridle tape in a piano-action according to some embodiments of the present disclosure.
Figure 3B:
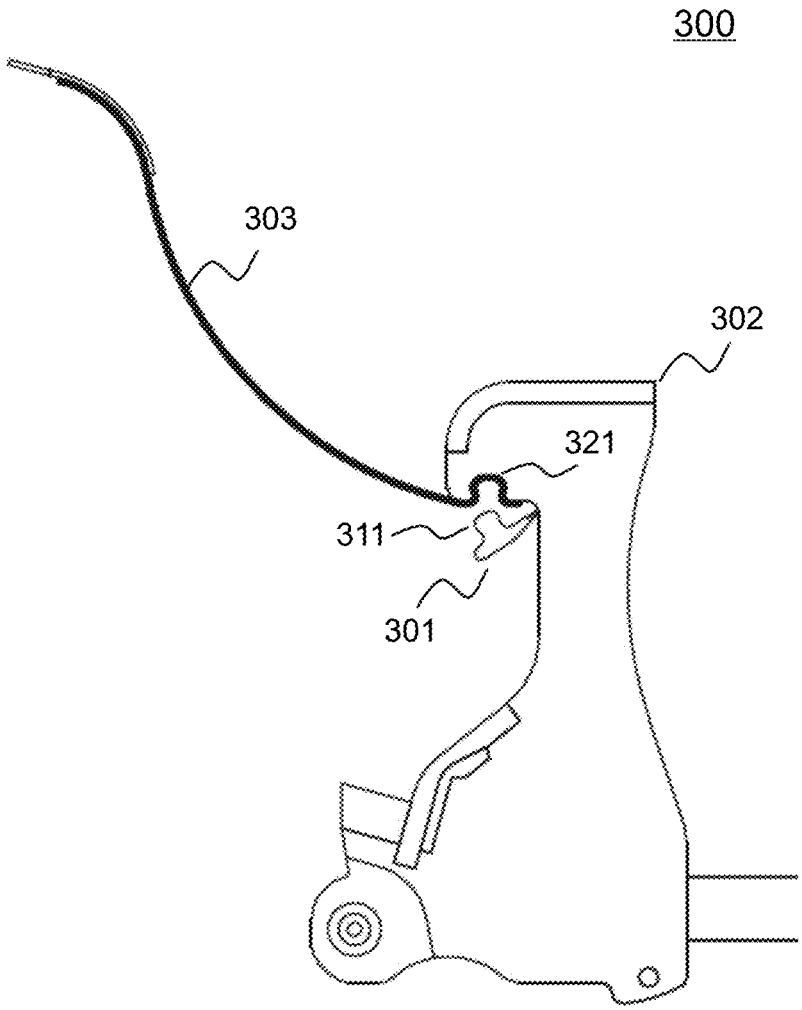

FIGS. 3A and 3B are schematic diagram illustrating a mechanical connection mechanism between hammer butt and bridle tape in a piano-action according to some embodiments of the present disclosure. The piano-action 300 may include a first moving component 301, a second moving component 302, and a third moving component 303. In combination with the piano-action 300 illustrated in FIGS. 3A and 3B, the first moving component 301 may be a tape-clip component, the second moving component 302 may be a hammer butt, and the third moving component 303 may be a tape (i.e., a bridle tape). In some embodiments, the connection mechanism illustrated in FIG. 3 may be applied to any connection between a flexible tape and a device or a component in a piano-action.

The first moving component 301 may include a convexity structure 311. In some embodiments, the convexity structure 311 may have a regular shape. For example, the convexity structure 311 may be a surface of a cylinder, a sphere, etc. In some embodiments, the convexity structure 311 may have an irregular shape.

The second moving component 302 may include a concavity structure 321. The convexity structure 311 of the first moving component 301 and the concavity structure 321 of the second moving component 302 may be configured to match each other. To be specific, the shape of the convexity structure 311 of the first moving component 301 and the shape of the concavity structure 321 of the second moving component 302 may be complementary.

In some embodiments, the convexity structure 311 of the first moving component 301 and the concavity structure 321 of the second moving component 302 may be capable of being clipped together. The "clipped together" used herein refers that the convexity structure 311 and the concavity structure 321 are fixed together without using other fastening devices or measures (e.g., bolts, adhesives, etc.), and can't be separated unless under a large stress. No adhesive is used to fasten the third moving component 303 to the first moving component 301 or the second moving component 302.

In some embodiments, an end of the first moving component may be connected to the second moving component through a mechanical joint. For example, screwed to the second moving component. The first moving component may move around the mechanical joint.

Merely for illustration purposes, two bumpings or two pits are arranged at a surface of the convexity structure 311 of the first moving component 301. Correspondingly, two pits or two bumpings are arranged at a surface of the concavity structure 321 of the second moving component 302. The "clipped together" refers to that two bumps on the convexity structure 311 of the first moving component 301 are clipped into two pits in the concavity structure 321 of the second moving component 302, or two bumps in the concavity structure 321 of the second moving component 302 are clipped into two pits on the convexity structure 311 of the first moving component 301.

The third moving component 303 may be bridle tape. The bridle tape may connect the hammer butt. The third moving component 303 may be thin and flexible. The third moving component 303 may be configured to fixedly fit between the first moving component 301 and the second moving component 302 when the convexity structure 311 of the first moving component 301 is clipped into the concavity structure 321 of the second moving component 302. In some embodiments, the shape of the convexity structure 311 of the first moving component 301 and the concavity structure 321 of the second moving component 302 are complementary. The third moving component 303 is fixedly fit between the concavity structure 321 of the second moving component 302 and the convexity structure 311 of the first moving component 301. After the convexity structure 311 of the first moving component 301 is clipped into the concavity structure 321 of the second moving component 302, the third moving component 303 may be fastened at a gap between the convexity structure 311 and the concavity structure 321. The third moving component may be thin in its width, and made of flexible material. In actual applications, the third moving component may be a bridle tape. A bridle tape may be fixed on the hammer butt conventionally. However, the bridle tape may be fixed using the above mechanism (i.e., fixed by the concavity structure 321 and the convexity structure 311).

As illustrated in FIG. 3A, the bridle tape may be placed between the convexity structure 311 and the concavity structure 321 before the convexity structure 311 is clipped into the concavity structure 321. In some embodiments, the bridle tape may fit into an inner surface of the concavity structure 321 when a force is imposed on the first moving component 301 and the convexity structure 311 is clipped into the concavity structure 321 of the second moving component 302. As illustrated in FIG. 3B, the bridle tape may be fixedly fit into a gap between the convexity structure 311 and the concavity structure 321.

Figure 4A:
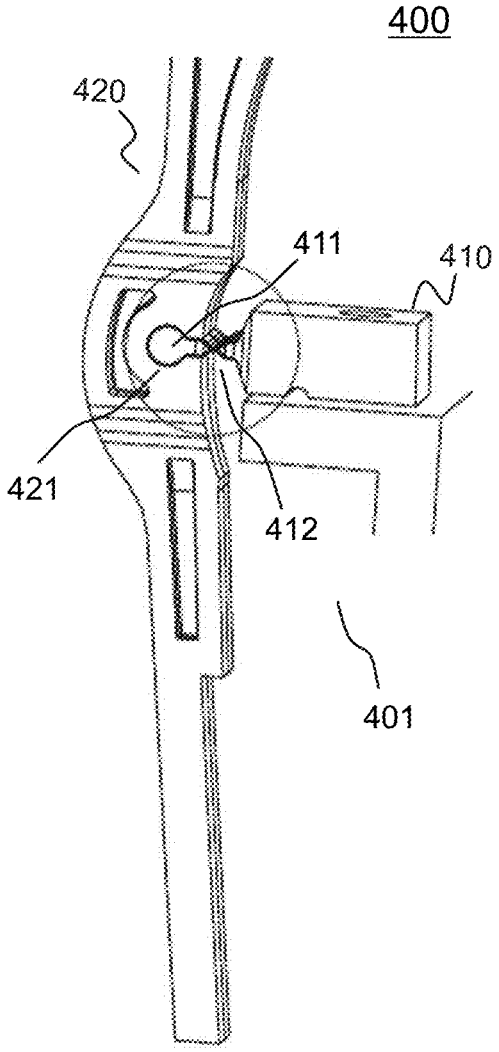
FIGS. 4A and 4B are schematic diagrams illustrating a mechanical connection mechanism between a damper lever flang and a damper lever in a piano-action according to some embodiments of the present disclosure.
Figure 4B:
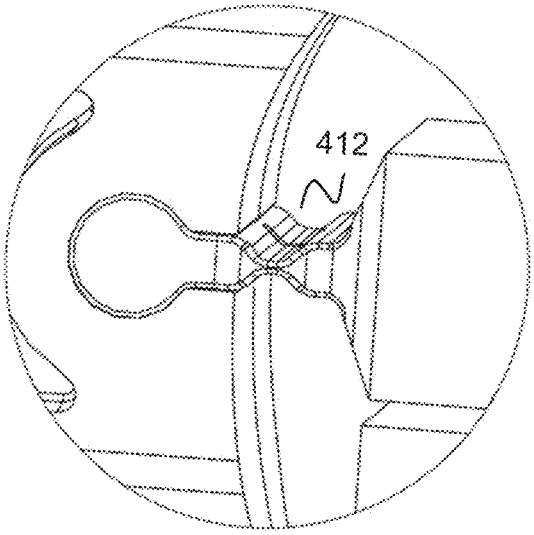

FIGS. 4A and 4B are schematic diagrams illustrating a mechanical connection mechanism between a damper lever flang and a damper lever in a piano-action according to some embodiments of the present disclosure. The piano-action 400 provided herein may be described in detail below with reference to the drawings. In some embodiments, the connection mechanism illustrated in FIGS. 4A and 4B may also be applied to a wippen shaft, a jack shaft, and/or a damper shaft.

The piano-action 400 may include at least one moving device 401. In some embodiments, the moving device 401 may have elasticity. A portion of the moving device 401 may move, relative to other portions, through deformation of the elasticity of the moving device. In some embodiments, the moving device 401 may include an elastic portion having a small thickness, and the elasticity of the moving device 401 may depend on the elastic portion.

In some embodiments, the moving device 401 may include one or more moving components. The one or more moving components may be configured to move relative to each other. In some embodiments, at least one of the one or more moving components may have an elastic portion, and the one or more moving components may move, relative to each other, through deformation of the elastic portion of the at least one moving component. In some embodiments, the elastic portion may be made of elastic material having a small thickness.

In some embodiments, the one or more moving components in the piano-action 400 may rotate under a small stress. Merely for illustration purposes, the one or more moving components of the moving device 401 may include a first moving component and a second moving component. At least one of the first moving component and the second moving component may have elasticity. Referring to FIG. 4A, the moving device 401 of the piano-action 400 may include a first moving component 410 and a second moving component 420. In combination with the piano-action 400 as illustrated in FIG. 4A, the first moving component 410 may be a damper lever flang, and the second moving component 420 may be a damper lever. The first moving component 410 may have a convexity structure 411. In some embodiments, the convexity structure 411 may have a regular shape. For example, the convexity structure 411 may be a surface of a cylinder, a sphere, etc. In some embodiments, the convexity structure 411 may have an irregular shape. The first moving component 410 may have an elastic portion 412. The second moving component 420 may have a concavity structure 421. The convexity structure 411 of the first moving component 410 and the concavity structure 421 of the second moving component 420 may be configured to match each other. In some embodiments, the shape of the convexity structure 411 of the first moving component 410 may be complementary to the shape of the concavity structure 421 of the second moving component 420.

FIG. 4B illustrates a partial enlarged view of the mechanical connection between the first moving component and the second moving component according to some embodiments of the present disclosure. The first moving component 410 may be physically fixed on the second moving component 420. In some embodiments, first moving component 410 may be physically fixed on the second moving component 420 by assembling the convexity structure 411 of the first moving component 410 into the concavity structure 421 of the second moving component 420. In some embodiments, the convexity structure 411 of the first moving component 410 and the concavity structure 421 of the second moving component 420 may be interference fit. In some embodiments, the convexity structure 411 may be configured at an end of the first moving component 410. The first moving component 410 may include an elastic portion 412 in the middle portion. The other end of the first moving component 410 may rotate, around the elastic portion, within a certain range in a plane including the first moving component 410 and second moving component 420, through the deformation of the elastic portion 412.

In some embodiments, since the elastic portion 412 is capable of having elastic deformation, the convexity structure 411 of the first moving component 410 may extrude into the concavity structure 421 of the second moving component 422 through elastic deformation of the elastic portion 412. The elastic portion 412 or the entire first moving component 410 may be made of elastic materials. The elastic materials may include but not limited to metallic materials, inorganic non-metallic materials, high polymer materials, composite materials, or the like. After being connected into components, the material toughness is used to rotate within a certain range.

The piano-action 400 provided may be applicable for a rotating component under a small stress, such that the shaft in the piano-action may be omitted to reduce manufacturing difficulty and avoid potential failures, thereby simplifying the manufacturing process and reducing the manufacturing cost of the piano-action.

Figure 5:
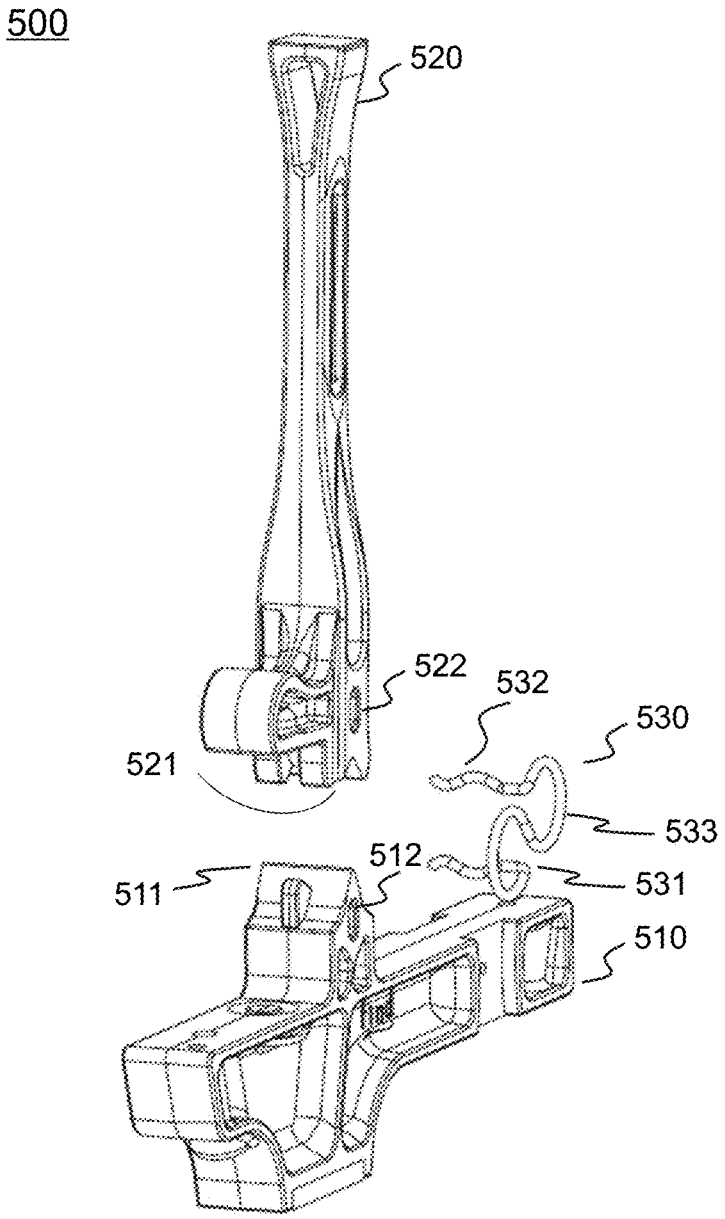
FIG. 5 is a schematic diagram illustrating a mechanical connection mechanism between a wippen and a jack in a piano-action according to some embodiments of the present disclosure.

FIG. 5 is a schematic diagram illustrating a mechanical connection mechanism between a wippen and a jack in a piano-action according to some embodiments of the present disclosure. The piano-action 500 may include a first moving component, a second moving component, and a connecting component configured to rotatably connect the first moving component to the second component without using a shaft. The first moving component may include a convexity structure. The second moving component may include a concavity structure. In some embodiments, the convexity structure of the first moving component and the concavity structure of the second moving component may be configured to each other. The connecting component may be configured to rotatably connect the first moving component to the second moving component by assembling the convexity structure into the concavity structure. In some embodiments, the connection mechanism illustrated in FIG. 5 may be applied to wippen shaft, a jack shaft, a damper shaft, or the like.

In some embodiments, the convexity structure may have a regular shape. For example, the convexity structure may be a surface of a cylinder, a sphere, etc. In some embodiments, the convexity structure may have an irregular shape. And the shape of the convexity structure of the first moving component and the shape of the concavity structure of the second moving component may be complementary.

The connection mechanism shown in FIG. 5 may be applied to multiple devices or components in a piano-action of a piano. For example, the connection mechanism may be applied to pin shaft, wippen shaft, jack shaft, damper shaft, or the like.

In some embodiments, the convexity structure and the concavity structure may have different radians. In some embodiments, the radian of the convexity structure may be defined as a, the radian of the concavity structure may be defined as β. The radian of the convexity structure a may be smaller than the radian of the concavity structure β, and the first moving component rotates, relative to the second moving component, in an angle range according to a difference between the radian of the concavity structure and the radian of the convexity structure (e.g., α-β). In some embodiments, the connecting component may have elasticity, and the convexity structure may be assembled into the concavity structure through a resilience force imposed by an elasticity deformation of the connecting component.

Merely for illustration purposes, the first moving component includes a first hole. The second moving component includes a second hole. The connecting component may be configured to assemble the convexity structure of the first moving component into the concavity structure of the second moving component. The connecting component may have elasticity. The connecting component may have a first sub-component, a second sub-component, and a third sub-component. The first sub-component may be inserted into the first hole, the second sub-component may be inserted into the second hole, and the third sub-component may be connected between the first sub-component and the second sub-component to control a distance from the first hole to the second hole. The third sub-component may have a curved shape.

In some embodiments, the first hole and/or the second hole may have various shape in a cross-sectional view. For example, the shape(s) of the first hole and/or the second hole may be round in a cross-sectional view. As another example, the shape(s) of the first hole and/or the second hole may be oval in a cross-sectional view. In some embodiments, a length direction of the hole(s) may be perpendicular to a plane in which the first moving component rotates relative to the second moving component. In some embodiments, the hole(s) may be straight in the length direction. In some embodiments, the hole(s) may curve in the length direction.

In some embodiments, the first sub-component may include a first rod, the second sub-component may include a second rod, and the third sub-component may include an elastic portion configured between the first rod and the second rod. In some embodiments, the first rod and the second rod may be straight rods, and the size of the first rod and the second rod may be configured to match the first straight hole and the second straight hole, respectively. In some embodiments, the first rod and/or the second rod may have a curved shape in the length direction, and the first hole and/or the second hole may be straight holes or curved holes.

The connecting component may connect the first moving component to the second moving component by inserting the two rods (i.e., the first rod and the second rod) into the two holes (i.e., the first hole and the second hole), respectively. The elastic portion may be arranged between the first rod and the second rod. In some embodiments, the distance between the first hole and the second hole may be larger than a vertical length of the connecting component. As used herein, the vertical length refers to a projection length of the connecting component on a direction from the first hole (deemed as a point) to the second hole (deemed as a point). The elastic portion may have an elasticity deformation when the two rods are inserted into the two holes, respectively. The elastic portion may assemble the convexity structure into the concavity structure through a resilience force imposed by the elasticity deformation of the connecting component.

Referring to FIG. 5, the piano-action 500 may include a first moving component 510, a second moving component 520, and a connecting component 530. The first moving component 510 may be a wippen (i.e., repetition base). The second moving component 520 may be a repetition jack. The first moving component 510 may include a concavity structure 511. The second moving component 510 may include a convexity structure 521. In some embodiments, at least a portion of the concavity structure 511 and at least a portion of the convexity structure 521 may be configured to match each other. For example, a middle portion of the concavity structure 511 and a middle portion of the convexity structure 521 may be configured to match each other. The first moving component 510 may include a first hole 512. The second moving component 520 may include a second hole 522. In some embodiments, the first hole 512 and/or the second hole 522 may have various shape in a cross-sectional view. For example, the shape(s) of the first hole 512 and/or the second hole 522 may be square in a cross-sectional view. In some embodiments, a length direction of the hole(s) may be perpendicular to a plane in which the first moving component 510 rotates relative to the second moving component 520.

The connecting component 530 may include a first sub-component 531, a second sub-component 532, and a third sub-component 533. The first sub-component 531 may include a first rod. The second sub-component 532 may include a second rod. The third sub-component 533 may include an elastic portion configured between the first rod and the second rod. In some embodiments, the first rod and the second rod may be straight rods, and the size of the first rod and the second rod may be configured to match the first straight hole and the second straight hole, respectively. In some embodiments, the first rod and/or the second rod may have a curved shape.

The first rod and the second rod may be inserted into the first hole 512 and the second hole 522. Since the distance between the first hole 512 and the second hole 522 may be larger than a vertical length of the connecting component 530 after the first rod and the second rod are inserted into the first hole 512 and the second hole 522, the elastic portion may have an elastic deformation. The connecting component 530 may rotatably connect the first moving component 510 to the second moving component 520 through a resilience force imposed by the elasticity deformation of the elastic portion.

The radian of the convexity structure 511 may be smaller than the radian of the concavity structure 521. And the second moving component 520 may rotate, relative to the first moving component 510, in an angle range according to a difference between the radian of the concavity structure 521 and the radian of the convexity structure 511. In this way, the rotation of the first moving component relative to the second moving component may not rely on a shaft, and difficulties for manufacturing a piano-action may be largely reduced as well.

Figure 6:
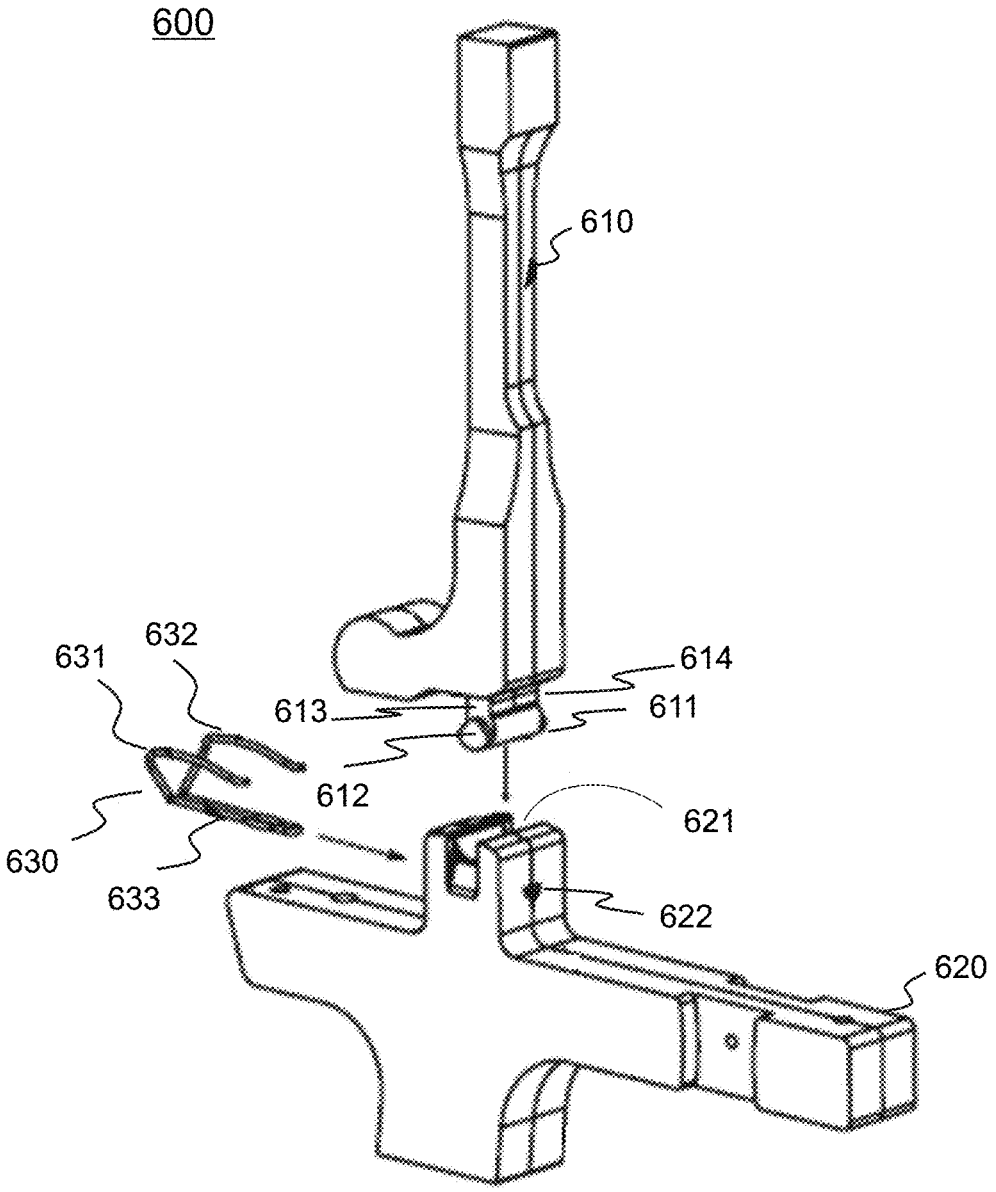
FIG. 6 is a schematic diagram illustrating a mechanical connection mechanism between a wippen and a jack in a piano-action according to some embodiments of the present disclosure.

FIG. 6 is a schematic diagram illustrating a mechanical connection mechanism between a wippen and a jack in a piano-action according to some embodiments of the present disclosure. The piano-action 600 may include a first moving component, a second moving component, and a connecting component configured to rotatably connect the first moving component to the second component without using a shaft. The first moving component may include a convexity structure. The second moving component may include a concavity structure. In some embodiments, the convexity structure of the first moving component and the concavity structure of the second moving component may be configured to match each other. The connecting component may be configured to rotatably connect the first moving component to the second moving component by assembling the convexity structure into the concavity structure. In some embodiments, the connection mechanism illustrated in FIG. 6 may be applied to wippen shaft, a jack shaft, a damper shaft, or the like.

In some embodiments, the convexity structure may have a regular shape. For example, the convexity structure may be a surface of a cylinder, a sphere, etc. In some embodiments, the convexity structure may have an irregular shape. And the shape of the convexity structure of the first moving component and the shape of the concavity structure of the second moving component may be complementary.

The connection mechanism shown in FIG. 6 may be applied to multiple devices or components in a piano-action of a piano. For example, the connection mechanism may be applied to pin shaft, wippen shaft, jack shaft, damper shaft, or the like.

In some embodiments, the convexity structure and the concavity structure may have different radians. In some embodiments, the radian of the convexity structure may be defined as a, the radian of the concavity structure may be defined as β. The radian of the convexity structure a may be smaller than the radian of the concavity structure β, and the first moving component rotates, relative to the second moving component, in an angle range according to a difference between the radian of the concavity structure and the radian of the convexity structure (α-β). In some embodiments, the connecting component may have elasticity, and the convexity structure may be assembled into the concavity structure through a resilience force imposed by an elasticity deformation of the connecting component.

Merely for illustration purposes, the first moving component may include a first notch and a second notch. The second moving component includes a hole. The connecting component may be configured to assemble the convexity structure of the first moving component into the concavity structure of the second moving component. The connecting component may have elasticity. The connecting component may have a first sub-component, a second sub-component, and a third sub-component. The first sub-component may be hooked in the first notch, the second sub-component may be hooked in the second notch, and the third sub-component may be inserted into the hole of the second moving component. In some embodiments, an end of the third sub-component may connect with the first sub-component and the second sub-component.

In some embodiments, the hole a may be a straight hole (in view of the length direction of the hole). The hole may have various shapes in a cross-sectional view. For example, the shape of the hole may be round in a cross-sectional view. As another example, the shape of the hole may be oval in a cross-sectional view. In some embodiments, the hole may curve in the length direction.

In some embodiments, the convexity structure of the first moving component may protrude in a direction perpendicular to the plane in which the first moving component rotates relative to the second moving component, and a protrusion may be formed. The first notch and the second notch are formed by the protrusion of the convexity structure. The depth(s) of the first notch and/or the second notch may be set according to the cross-sectional size of the first sub-component and/or the second sub-component.

In some embodiments, the first sub-component may include a first hook, the second sub-component may include a second hook, and the third sub-component may include a rod. An end of the rod may connect with the first hook and the second hook. In some embodiments, both the first hook and the second hook may include a curved portion, and the rod may be a straight rod.

The connecting component may connect the first moving component to the second moving component by inserting the rod into the hole on the second component and assembling the first hook and the second hook into the first notch and the second notch, respectively. In some embodiments, the distance between the first hook and the hole or the distance between the second hook and the hole may be larger than a vertical length of the connecting component. As used herein, the vertical length refers to a projection length of the connecting component on a direction from the first/second notch (deemed as a point) to the hole (deemed as a line). In some embodiments, both the first hook and the second hook may include a curved portion, and the curved portion may be deformable. The curved portion may assemble the convexity structure into the concavity structure through a resilience force imposed by the elasticity deformation of the curved portion.

Referring to FIG. 6, the piano-action 600 may include a first moving component 610, a second moving component 620, and a connecting component 630. The first moving component 610 may be a repetition jack. The second moving component 620 may be a wippen (i.e., repetition base). The first moving component 610 may include a convexity structure 611. The second moving component 610 may include a concavity structure 621. In some embodiments, at least a portion of the convexity structure 611 and at least a portion of the concavity structure 621 may be configured to match each other. For example, a middle portion of the convexity structure 611 and a middle portion of the concavity structure 621 may be configured to match each other. The first moving component 610 may include a first notch 613 and a second notch 614. The second moving component 620 may include a hole 622. In some embodiments, the convexity structure 611 of the first moving component 610 may protrude in a direction perpendicular to the plane in which the first moving component 610 rotates relative to the second moving component 620, and a protrusion 612 may be formed. In some embodiments, the first notch 613 and the second notch 614 may be close to the protrusion 612. Merely by ways of example, the first notch 613 and the second notch 614 may be formed by the protrusion 612 of the convexity structure 611. In some embodiments, the hole 622 may be a straight hole. The hole 622 may have various shapes in a cross-sectional view. For example, the shape of the hole 622 may be round in a cross-sectional view.

The connecting component 630 may include a first sub-component 631, a second sub-component 632, and a third sub-component 633. The first sub-component 631 may include a first hook. The second sub-component 632 may include a second hook. The third sub-component 533 may include a rod. An end of the rod may connect with the first hook and the second hook. In some embodiments, the first hook and the second hook may have a curved portion, and the size of the first hook and the second hook may be configured to match the first notch 613 and the second notch 614, respectively.

The first hook 631 and the second hook 632 may be assembled into the first notch 613 and the second notch 614 of the first moving component 610, and the rod may be inserted into the hole 622 on the second moving component 620. Since the distance between the first hook 631 and the hole 622 or the distance between the second hook 632 and the hole 622 may be larger than a vertical length of the connecting component 630, the curved portions of the first hook 631 and the second hook 632 may have elastic deformations. The connecting component 630 may rotatably connect the first moving component 610 to the second moving component 620 through a resilience force imposed by the elasticity deformation of the curved portions.

The radian of the convexity structure 611 may be smaller than the radian of the concavity structure 621. And the first moving component 610 may rotate, relative to the second moving component 620, in an angle range according to a difference between the radian of the concavity structure 621 and the radian of the convexity structure 611. In this way, the rotation of the first moving component relative to the second moving component may not rely on a shaft, and difficulties for manufacturing a piano-action may be largely reduced as well.

Figure 7:
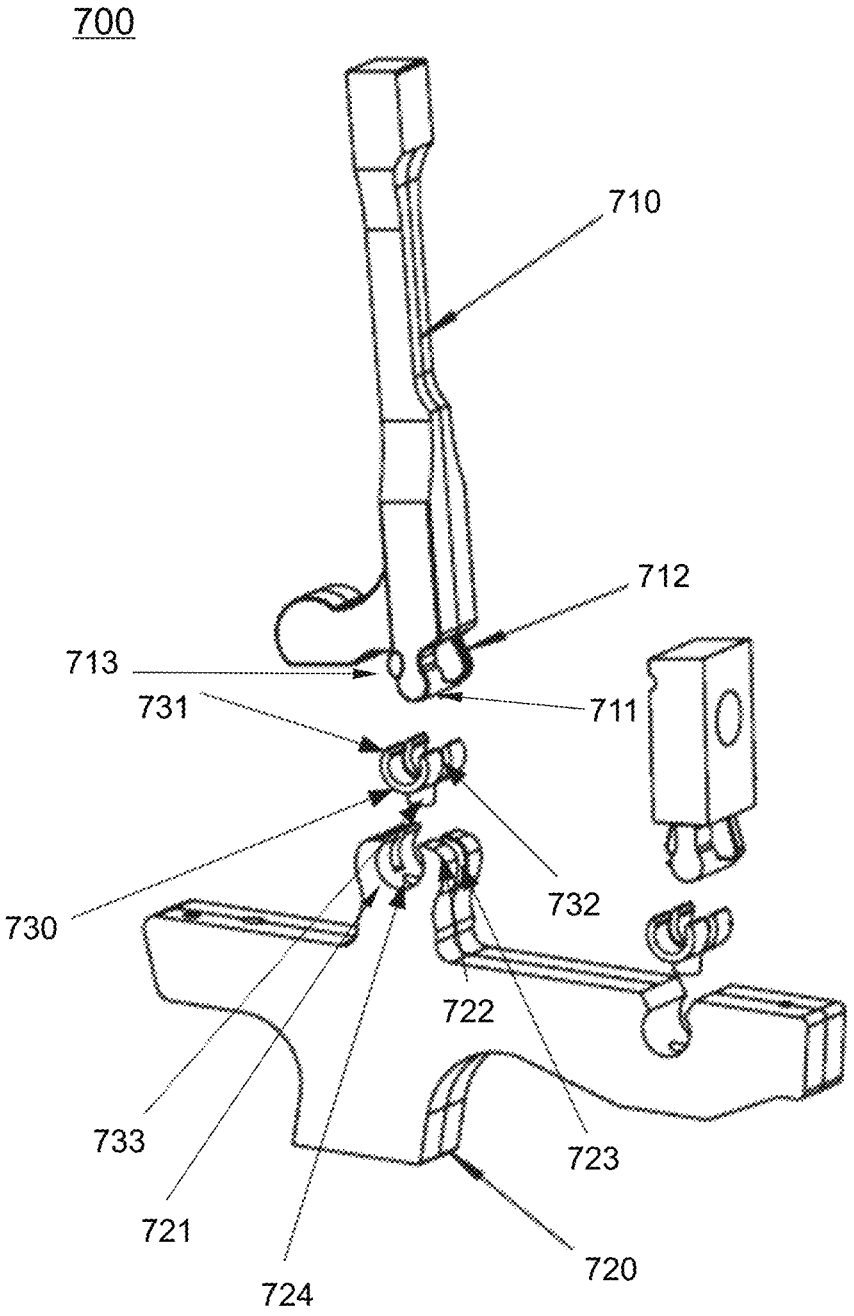
FIG. 7 is a schematic diagram illustrating a mechanical connection mechanism between a wippen and a jack in a piano-action according to some embodiments of the present disclosure.

FIG. 7 is a schematic diagram illustrating a mechanical connection mechanism between a wippen and a jack in a piano-action according to some embodiments of the present disclosure. The piano-action 700 may include a first moving component, a second moving component, and a connecting component configured to rotatably connect the first moving component to the second component without using a shaft. The first moving component may include a convexity structure. The second moving component may include a concavity structure. The connecting component may be configured to rotatably connect the first moving component to the second moving component by assembling the convexity structure into the concavity structure. In some embodiments, the connection mechanism illustrated in FIG. 7 may be applied to wippen shaft, a jack shaft, a damper shaft, or the like.

In some embodiments, the convexity structure may have a regular shape. For example, the convexity structure may be a surface of a cylinder, a sphere, etc. In some embodiments, the convexity structure may have an irregular shape.

The connecting component may be a bushing. In some embodiments, the connecting component may be an arc-shaped bushing. The arc-shaped bushing may be arranged between the convexity structure of the first moving component and the concavity structure of the second moving component so as to assemble the convexity structure into the concavity structure. An inner surface of the arc-shaped bushing may be configured to match the convexity structure of the first moving component, and an outer surface of the arc-shaped bushing may be configured to match the concavity structure of the second moving component.

The connection mechanism shown in FIG. 7 may be applied to multiple devices or components in a piano-action of a piano. For example, the connection mechanism may be applied to pin shaft, wippen shaft, jack shaft, damper shaft, or the like.

Referring to FIG. 7, the piano-action 700 may include a first moving component 710, a second moving component 720, and a connecting component 730. The first moving component 710 may be a repetition jack. The second moving component 720 may be a wippen (i.e., repetition base). The first moving component 710 may include a convexity structure 711. The second moving component 720 may include a concavity structure 721. The first moving component 710 may include at least one pair of insertion pieces arranged at two opposite sides of the convexity structure 711. In some embodiments, the at least one pair of insertion pieces may be solid slices. Merely for illustration purposes, the first moving component 710 may include a pair of insertion pieces 712 and 713 arranged at two opposite sides of the convexity structure 711. The pair of insertion pieces 712 and 713 may be arranged in a plane in which the first moving component 710 rotates relative to the second moving component 720 or another plane parallel to the plane. The second moving component 720 may include a groove 724 at the bottom of the concavity structure 721, at least two pairs of primary flanks (including, for example, a primary flank 722), and primary slots (including, for example, a slot 723) between adjacent primary flanks at a same side of the concavity structure 721. Each pair of primary flanks may be arranged at two opposite sides of the concavity structure 721.

The connecting component 730 may be a bushing. In some embodiments, the bushing may be an arc-shaped bushing. The arc-shaped bushing 730 may be arranged between the convexity structure 711 of the first moving component 710 and the concavity structure 721 of the second moving component 720 so as to assemble the convexity structure 721 into the concavity structure 722. An inner surface of the arc-shaped bushing 730 may be configured to match the convexity structure 711 of the first moving component 710, and an outer surface of the arc-shaped bushing 730 may be configured to match the concavity structure 721 of the second moving component 720. In some embodiments, the convexity structure 711, the arc-shaped bushing 730 and the concavity structure 721 may have different radians. The radian of the convexity structure 711 may be smaller than the radian of the arc-shaped bushing 730, and the radian of the arc-shaped bushing 730 may be smaller than the radian of the concavity structure 721.

The connecting component 730 may include at least two pairs of secondary flanks (including, for example, a secondary flank 731) at two opposite sides of the bushing, secondary slots (including, for example, a secondary slot 732) between adjacent secondary flanks at a same side, and a positioning slice 733 at the middle of the outer surface of the bushing. The at least two pairs of secondary flanks being configured to match the at least two pairs of primary flanks, the positioning slice 733 being configured to match the groove 724, and secondary slots may be configured to match the insertion pieces on the first moving component 710. In some embodiments, thicknesses of the insertion pieces may be set according to the widths of the secondary slots. For example, if the thickness of an insertion piece is 2.0 millimeter, the width of a secondary slot corresponding to the insertion piece may be set to 2.05 millimeter, 2.1 millimeter, etc. In some embodiments, the widths of the secondary slots may be set according to the widths of the primary slots. For example, the widths of the secondary slots may be equal to the widths of the primary slots.

The connecting component 730 may connect the first moving component 710 to the second moving component 720 in two steps. Firstly, the convexity structure 711 of the first moving component may be assembled into the inner surface of the bushing 730. During the first step, the convexity structure 711 of the first moving component 710 may be assembled into the inner surface of the bushing 730, and the at least one pair of insertion pieces may be slid into the secondary slots of the bushing 730. Then the bushing 730 may be assembled into the concavity structure 721 of the second moving component 720 together with the first moving component 710. During the second step, the positioning slice 733 may be inserted into the groove 724, and the at least two pairs of secondary flanks may be clasped beneath the at least two pairs of primary flanks.

A gap may be set between the convexity structure 711 and the inner surface of the bushing 730 such that the first moving component 710 may rotate relative to the bushing 730 by rolling within the inner surface of the bushing 730. The bushing 730 and the second moving component may be relatively fixed after the positioning slice 733 is inserted into the groove 724. An angle range in which the first moving component 710 rotates relative to the bushing 730 and the second moving component 720 may be determined according to the size of the secondary slots on the bushing 730 and the insertion pieces on the first moving component in an arc direction of the bushing 730. In this way, the rotation of the first moving component relative to the second moving component may not rely on a shaft, and difficulties for manufacturing a piano-action may be largely reduced as well.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "module," "unit," "component," "device," or "system." Furthermore, aspects of the present disclosure may take the form of a computer program product embodied in one or more computer readable media having computer readable program code embodied thereon.

A computer readable signal medium may include a propagated data signal with computer readable program code embodied therein, for example, in baseband or as part of a carrier wave. Such a propagated signal may take any of a variety of forms, including electro-magnetic, optical, or the like, or any suitable combination thereof. A computer readable signal medium may be any computer readable medium that is not a computer readable storage medium and that may communicate, propagate, or transport a program for use by or in connection with an instruction execution system, apparatus, or device. Program code embodied on a computer readable signal medium may be transmitted using any appropriate medium, including wireless, wireline, optical fiber cable, RF, or the like, or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB. NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claim subject matter lie in less than all features of a single foregoing disclosed embodiment.

What is claimed is:

1. A piano-action, comprising:

a moving device, the moving device including one or more moving components, wherein at least one of the moving components includes an elastic portion, wherein the one or more moving components include:

a first moving component having a convexity structure; and a second moving component having a concavity structure, wherein the first moving component includes the elastic portion, the convexity structure of the first moving component is configured to extrude into the concavity structure of the second moving component through elastic deformation of the elastic portion, and a second end of the first moving component is configured to move, relatively to the second moving component, through deformation of the elastic portion.

2. The piano-action of claim 1, wherein the second end of the first moving component is configured to rotate around the elastic portion.

3. The piano-action of claim 1, wherein the elastic portion is made of elastic material having a small thickness.

4. The piano-action of claim 1, wherein the material of the elastic portion includes metallic materials, inorganic non-metallic materials, high polymer materials, or composite materials.

5. A piano-action, comprising:

a first moving component including a convexity structure;

a second moving component including a concavity structure; and a connecting component configured to rotatably connect the first moving component to the second moving component by assembling the convexity structure into the concavity structure, wherein the connecting component has elasticity, the convexity structure and the concavity structure have different radians and are configured to match each other, and the convexity structure is assembled into the concavity structure through a resilience force imposed by an elasticity deformation of the connecting component.

6. The piano-action of claim 5, wherein the radian of the concavity structure is larger than the radian of the convexity structure, and the first moving component rotates, relative to the second moving component, in an angle range according to a difference between the radian of the concavity structure and the radian of the convexity structure.

7. The piano-action of claim 5, wherein the first moving component includes a first hole perpendicular to a plane in which the first moving component rotates relative to the second moving component, the second moving component includes a second hole parallel to the first hole, the connecting component includes a first rod, a second rod, and an elastic portion configured between the first rod and the straight rod, the first rod and the second rod being configured to insert into the first hole and the second hole, respectively, and the connecting component connects the first moving component to the second moving component through a resilience force imposed by an elasticity deformation of the elastic portion.

8. The piano-action of claim 5, wherein the first moving component includes a first notch in a first plane and a second notch in a second plane, the first plane and the second plane being parallel to each other, the second moving component includes a hole in a third plane parallel to the first plane and second plane, the connecting component includes a first hook, a second hook, and a rod, the first hook and the second hook being deformable, and the connecting component connects the first moving component to the second moving component by inserting the rod into the hole and assembling the first hook and the second hook into the first notch and the second notch, respectively.

9. The piano-action of claim 8, wherein the convexity structure protrudes in a direction perpendicular to the first plane and the second plane, the first notch and the second notch being close to the protrusion of the convexity structure.

* * * * *